United States Patent [19]

Daussan et al.

[11] 4,337,930

[45] Jul. 6, 1982

[54] HEAT INSULATING LINING FOR A METALLURGICAL CONTAINER

[75] Inventors: Jean-Charles Daussan; Gerard Daussan, both of Metz; Andre Daussan, Longeville les Metz, all of France

[73] Assignee: Daussan et Compagnie, Woippy, France

[21] Appl. No.: 197,533

[22] Filed: Oct. 16, 1980

[30] Foreign Application Priority Data

Oct. 23, 1979 [FR] France ..... 79 26227

[51] Int. Cl.[3] ..... C21C 7/00

[52] U.S. Cl. ..... 266/283; 52/593; 52/594

[58] Field of Search ..... 266/283, 284, 28 L; 52/593, 594

[56] References Cited

U.S. PATENT DOCUMENTS

| | | | |
|---|---|---|---|
| 1,670,678 | 5/1928 | Cowper | 52/593 |
| 2,805,852 | 9/1957 | Malm | 266/283 |
| 3,183,625 | 5/1965 | Agnew | 266/283 |
| 3,719,016 | 3/1973 | Randolph | 52/593 |
| 4,055,336 | 10/1977 | Massin | 266/283 |

*Primary Examiner*—G. O. Peters

*Attorney, Agent, or Firm*—Young & Thompson

[57] ABSTRACT

The lining for a metallurgical container comprises a series of removable plates of heat insulating material designed to be applied to the inside of the metallurgical container against the lateral walls and the bottom of the latter, at least a part of these plates being quadrangular and identical. The quadrangular and identical plates include on their two opposite edges a rib extending over a major fraction of the length of the corresponding edge, this rib defining a support surface designed to receive an identical rib formed along the adjacent edge of another plate. Each plate includes also, on the remaining fraction of the length of said edge, a protuberance defining a support surface oriented in the opposite direction with respect to that of the rib, the support surface of this protuberance being designed to receive an identical protuberance formed on the adjacent edge of another plate. The invention is particularly useful for the internal coating of casting distributors or tundishes.

6 Claims, 6 Drawing Figures

HEAT INSULATING LINING FOR A METALLURGICAL CONTAINER

BACKGROUND OF THE INVENTION

1. Field of the Invention

The present invention relates to a lining for a metallurgical container, comprising a series of removable plates of heat-insulating material, designed to be applied to the inside of the metallurgical container against the lateral walls and the bottom of the latter.

The invention relates also to a metallurgical container, especially a tundish comprising such a heat insulating lining.

2. Description of the Prior Art

It is known that such heat insulating plates enable the permanent refractory brick lining of a casting tundish or of a casting ladle, to be protected against wear caused by the liquid metal which is poured into such metallurgical containers.

In addition, these heat-insulating plates ensure effective thermal insulation of the walls of the metallic container, avoiding in particular the risks of solidification of the metal against these walls especially at the beginning of casting. Moreover, due to these heat-insulating plates, the long and expensive preheating of these metallurgical containers before the start of casting, is avoided. On the other hand, these plates, taking into account their removable character, considerably simplify the cleaning of metallurgical containers at the end of casting.

These heat-insulating plates are molded in parallelepipedic molds from a pasty mixture comprising refractory particles (silica, magnesia, alumina and the like), vegetable, animal, mineral, natural or synthetic fibers and an organic binder (for example phenolic resin) or inorganic binder (for example refractory cement).

On the positioning of these heat insulating plates against the walls of the metallurgical container, at least certain of them must be cut up to permit their adaptation to the shape of the metallurgical container. These plates must then be fixed to the walls of the metallurgical container with fastening means such as nails, hooks, studs or the like. Morevoer, the interstices comprised between the adjacent edges of juxtaposed plates must be joined, for example by refractory cement in order to avoid the liquid metal reaching the sub-adjacent permanent lining.

All these operations of assembly, fixing and joining plates are long and hence expensive.

It is an object of the present invention to overcome the aforesaid drawbacks, by providing a lining composed of heat-insulating removable plates whose application is particularly convenient and economical.

It is another object of the invention to avoid in particular the fastening of the plates to the walls of the metallurgical container.

It is a further object of the invention to eliminate to a large extent the delicate joining of the adjacent edges of the plates.

Other objects and advantages of the invention will be apparent from the description which follows.

GENERAL DESCRIPTION OF THE INVENTION

The lining for a metallurgical container according to the invention comprises a series of removable plates of heat-insulating material designed to be applied to the inside of the metallurgical container against the lateral walls and the bottom of the latter, at least a part of these plates being quadrangular and identical.

According to the invention, this lining is characterised in that the quadrangular and identical plates designed to be applied against the lateral walls of the metallurgical container comprise on two of their opposite edges a rib extending over a preponderant fraction of the length of the corresponding edge, this rib defining a support surface intended to receive an identical rib formed along the adjacent edge of another plate, and wherein each plate comprises on the remaining fraction of the length of said edge, a protuberance defining a support surface oriented in the opposite direction with respect to that of the rib, the support surface of this protuberance being designed to receive an identical protuberance formed on the adjacent edge of another plate.

Due to the protuberances which serve as countersupport for the rib, the adjacent edges of the plates are locked with respect to one another in a direction perpendicular to the surface defined by the assembly of plates. Thus, when these plates are in position in the metallurgical container, supported against the lateral walls of the latter, they cannot fall towards the inside of the container. It is unnecessary for this reason to fix them to the walls of the container by nails, hooks or the like.

In addition, the rib formed on the opposite edges of the plates enable the production between the adjacent edges of the plates of sufficient fluid-tightness which avoids expensive jointing by a refractory cement.

On the other hand, all these plates being identical, they can be produced economically from a single mold.

According to a preferred embodiment of the invention, at least a part of the plates designed to be applied to the bottom of the container being quadrangular and identical, these plates include on one of their surfaces and along two opposite edges, a groove designed to receive the lower edge of the plates including the rib and the protuberances.

The lower edge of the plates applied against the lateral wall of the metallurgical container is thus fitted along plates applied against the bottom of the container. The plates applied against the lateral wall of the container thus do not risk being separated from this wall on the introduction of the liquid metal into this container.

The invention also provides a metallurgical container comprising a thermally insulating lining composed of the aforesaid plates.

In the case of a tundish, this container has the general shape of a prism with a trapezoidal base. In such a case, all the plates may be identical with the exception of those adjacent to the trapezoidal walls of the container.

Other features and advantages of the invention will also appear from the following description.

BRIEF DESCRIPTION OF THE DRAWINGS

In the accompanying drawings, showing preferred embodiments of the invention, given purely by way of non-limiting example.

DESCRIPTION OF PREFERRED EMBODIMENTS

Figure 1:
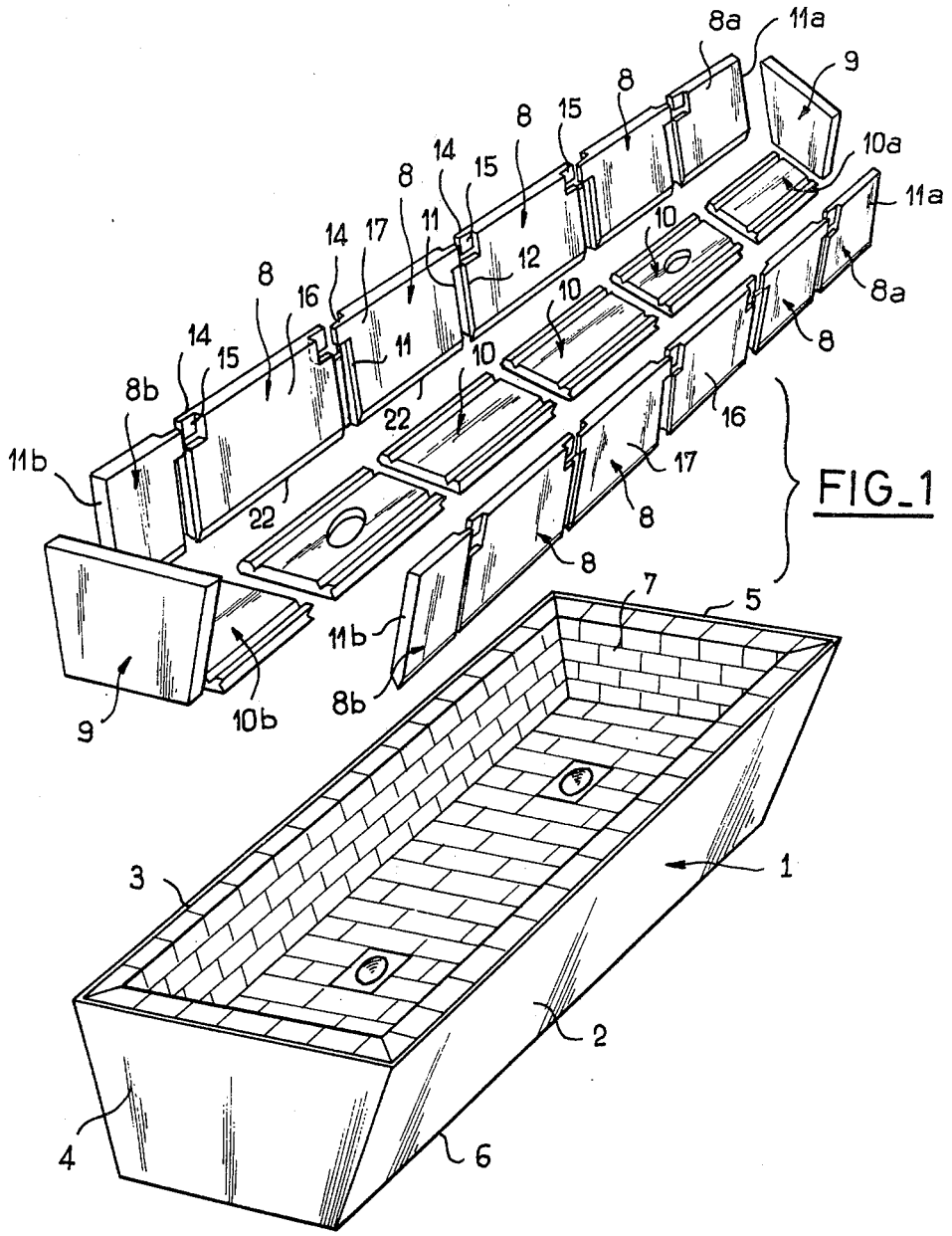
FIG. 1 is an exploded perspective view, showing an embodiment of a lining according to the invention composed of plates and a tundish designed to receive this lining.

In the embodiment of FIG. 1, the casting distributor, or tundish 1 in the general shape of a prism with a trapezoidal base comprises on its lateral walls 2, 3, 4, 5 and on its bottom 6, a permanent lining 7 of refractory brick.

To protect this permanent lining 7, the lateral walls 2, 3 of the distributor 1 receive removable and heat insulatable rectangular plates 8, 8*a* 8*b*, the trapezoidal lateral walls 4, 5 of the trapezoidal plates 9 and the bottom 6 of the rectangular plates 10, 10*a* and 10*b*. The dimensions of all these plates are adapted to the internal dimensions of the distributor 1 so as to form inside the latter a substantially continuous heat insulating lining.

The plates 8 are all identical with one another in the same way as the plates 9, as well as the plates 10.

Figure 2:
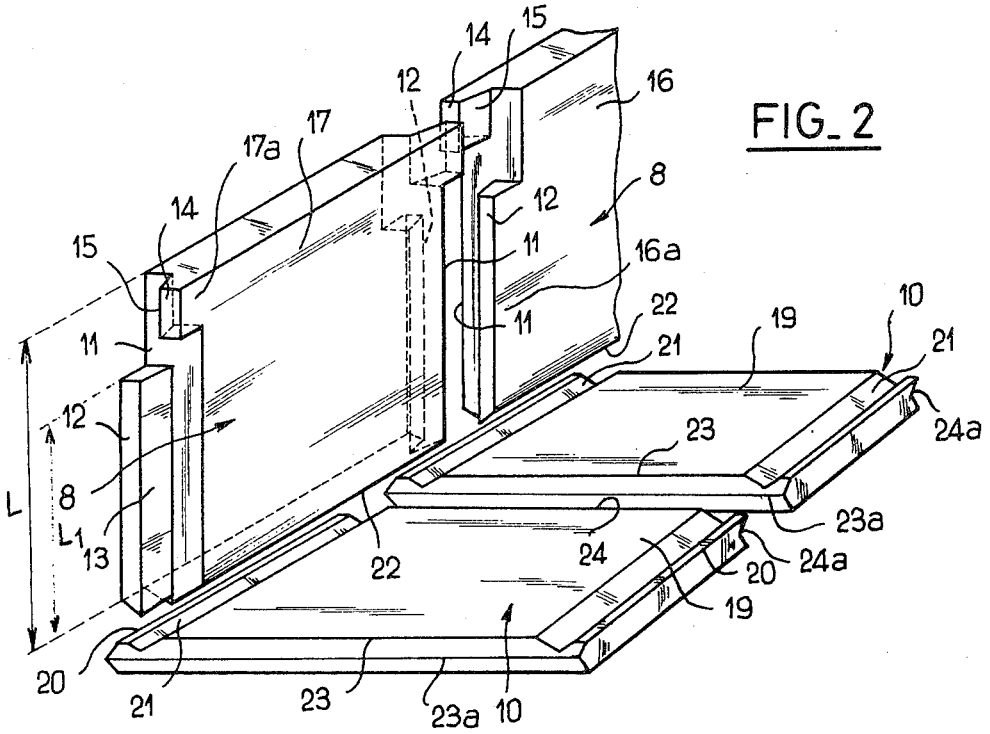
FIG. 2 is a perspective view, with a part torn away and on an enlarged scale, showing the assembly of several plates of the lining.

In FIG. 1 and particularly in FIG. 2 it is seen that the plates 8 destined to be applied against the lateral walls 2 or 3 of the distributor 1 include on two of their opposite edges 11, a rib 12 extending over a preponderant fraction of the length L of the corresponding edge 11. In other words, as seen in FIG. 2, L1 is most of L. This rib 12 defines a support surface 13 destined to receive an identical rib 12 formed along the adjacent edge 11 of another plate 8.

On the other hand, each plate 8 includes on the remaining fraction of the length L of each edge 11, a protuberance 14 or tongue defining a support surface 15 oreinted in the opposite direction with respect to the support surface 13 of the ribs 12. The support surface 15 of each protuberance 14 is destined to receive an identical protuberance 4 formed on the adjacent edge 11 of another plate, as indicated in FIG. 2.

Thus, when two plates 8 are assembled by their adjacent edges 11 and supported against the lateral wall 3 (or 2) of the distributor 1, the support surfaces 13 of the ribs 12 (see FIG. 4) and the support surfaces 15 of the protuberances 14 (see FIG. 3) are in mutually supporting position. The two plates 8 are thus locked with respect to one another in a direction perpendicular to the surface defined by these two plates, so that they cannot tilt independently of one another towards the inside of the casting distributor 1.

On the other hand, in the example shown, the support surfaces 13 defined by the two ribs 12 formed on the opposite edges 11 of a plate 8 are oriented substantially in the same direction. In addition, the surfaces 16*a*, 17*a* opposite the support surfaces 13, 15 defined respectively by the ribs 12 and the protuberances 14 are situated in extension of the corresponding surfaces 16 and 17 of each plate 8.

Preferably the shoulder 12 of the plates 8 extend over a length L1 greater than the height of the level of the liquid metal which is intended to be introduced into the casting distributor 1.

In this way the passage of the metal by the play in the assembly 18 (see FIG. 6) situated below the protuberances 15 of the adjacent plates 8, is avoided.

As indicated notably in FIG. 2, the rectangular plates 10 designed to be applied on the bottom of the casting distributor 1, comprise on their surface 19 and along their two opposite edges 20, a groove 21 designed to receive the lower edge 22 of the plates 8. These grooves 21 have a V-shaped cross-section, the lower edge 22 of the plates 8 being of a profile complementary with this section of the grooves 21.

Figure 6:
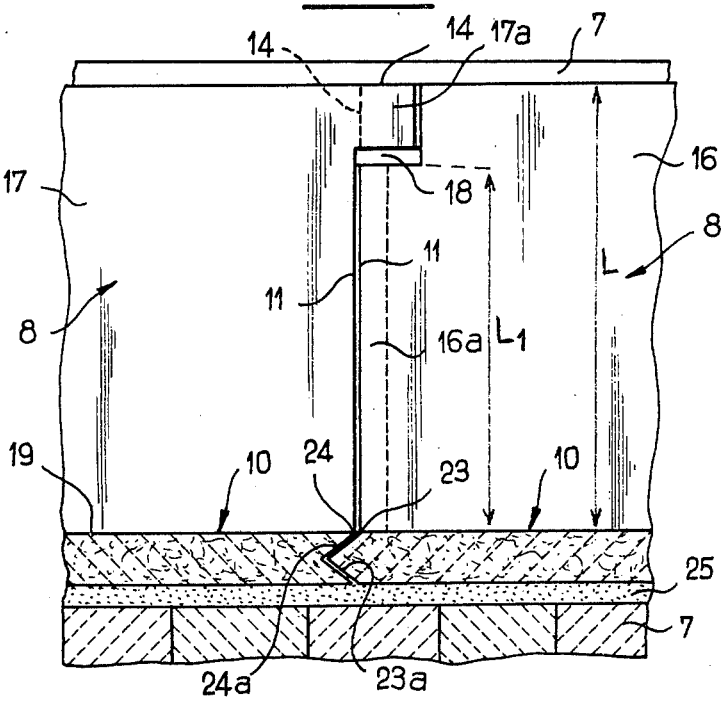
FIG. 6 is a view in partial section along the line VI—VI of FIG. 5.

On the other hand, the two other edges 23 and 24 of the plates 10 include preferably on the first, a longitudinal projection 23*a* of the V-shaped cross-section, and on the second a longitudinal recesss 24*a* of section complementary with the aforementioned projection 23*a*. The projection 23*a* of the edge 23 of one of the plates 10 therefore fits exactly into the complementary recess 24*a* of the edge 24 of the adjacent plate 10, as indicated in FIG. 6.

To compensate for possible unevenness in the surface of the permanent lining 7 of refractory brick and to improve the thermal insulation of the casting distributor 1, it is possible to arrange between the plates 8, 8*a*, 8*b*, 9, 10, 10*a* and 10*b* a layer 25 of sand or of compressible material based on mineral fibers, as indicated in FIGS. 3 to 6.

Figure 3:
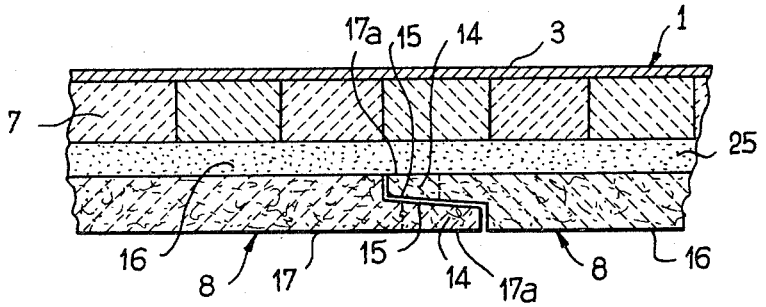
FIG. 3 is a view in partial cross-section of the lateral wall of a tundish, showing the assembly of two plates at the level of their adjacent rib.
Figure 4:
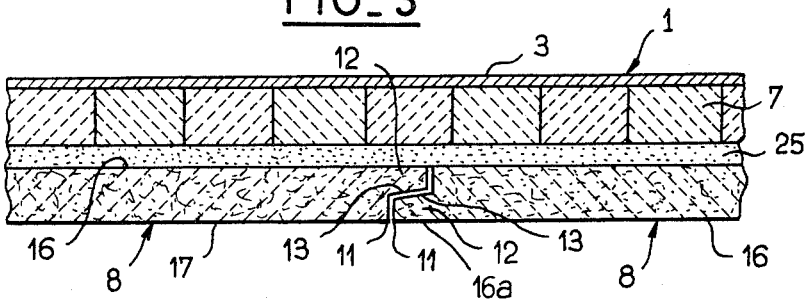
FIG. 4 is a view similar to that of FIG. 3, showing the assembly of two plates at the level of their adjacent protuberances.
Figure 5:
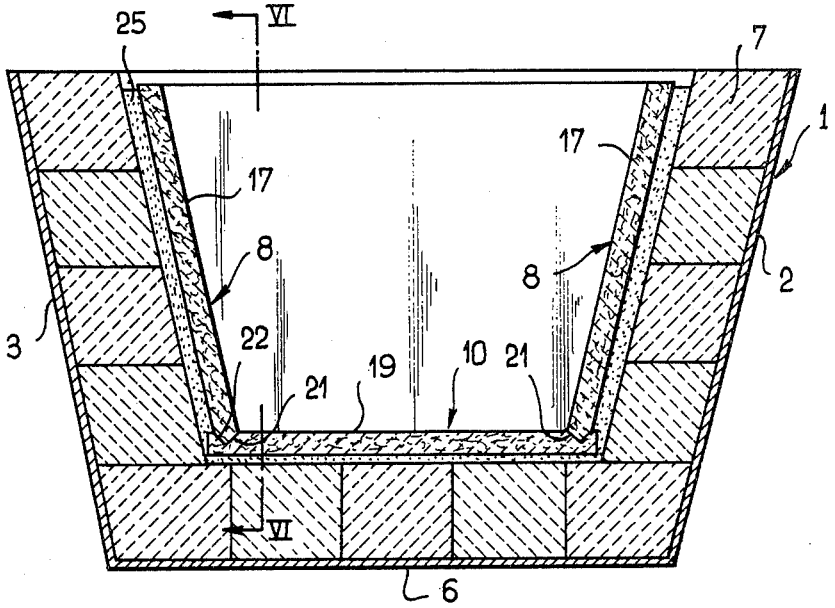
FIG. 5 is a view in longitudinal section of a tundish including a lining according to the invention.

In addition, the thickness of the protuberances 14 and of the ribs 12 may be decreased towards their free end, as is seen especially in FIGS. 3 and 4.

To apply to the lateral walls 2, 3, 4, 5 and to the bottom 6 of the casting distributor 1, the heat insulating lining which has just been described, procedure is as follows:

One commences by applying to the bottom 6 of the distributor 1, a layer of sand 25 or the like to equalize the surface of this bottom 6. One then applies to this bottom 6, identical rectangular plates 10 fitting them together by their adjacent edges 23 and 24. The size of the plates 10*a* and 10*b* destined to be positioned at the facing ends of the trapezoidal walls 4 and 5 is adjusted by cutting.

To the lateral walls 2 and 3 are then applied the rectangular and identical plates 8, fitting their lower edges 22 into the grooves 21 of the plates 10, 10*a* and 10*b* positioned on the bottom 6 of the distributor 1 and assembling their vertical edges 11 so that the ribs 12 and the protuberances 14 come into mutual support. The dimensions of the terminal plates 8*a* and 8*b* are then adjusted by cutting.

It then suffices to apply the trapezoidal-shaped plates 9 like wedges against the cut-out edges 11*a*, 11*b* of the terminal plates 8*a* and 8*b* in order to jam the latter against the lateral walls 2 and 3 of the distributor 1.

All the plates being positioned in the casting distributor 1, the latter is ready to receive liquid metal without any additional fixing of plates against the wall of the distributor, nor any jointing of joint-filling of these plates, for example by means of a refractory cement. In fact, due to the rib 12 and to the protuberances 14 having oppositely directed support surfaces and to the fitting of the lower edge 22 of the latter in the grooves 21 of the plates 10 as well as to the wedging ensured by the trapezoidal plates 9, the plates 8 run no risk of tilting towards the inside of the casting distributor 1 on the rise of the liquid metal in the latter.

In addition, due to the junction of the plates 8 by overlapping of the rib 12 and to the junction of the plates 10 by the fitting of their adjacent edges 23 and 24, sufficient fluid-tightness between the different plates is obtained so that it is unnecessary to fill the joints with a refractory cement.

In addition, given that the assembly of plates, not including the trapezoidal plates 9, is composed of identical plates 8 on the one hand, and of equally identical plates 10 on the other hand, the manufacture of the latter can be carried out by means of only two molds. The production of the lining according to the invention is for this reason rapid and economical to put into operation.

Of course, the invention is not limited to the examples which have just been described and it is possible to introduce into the latter numerous modifications without departing from the scope of the invention.

Thus, the heat-insulating lining according to the invention may be applied to any metallurgical container, and in particular to a casting ladle.

Moreover, the shape of the grooves 21, of the complementary profile of the lower edge 22 of the plates 8, of the longitudinal projections 23*a* and of the complementary recesses 24*a* of the respective edges 23 and 24 of the plates 10 may be modified, provided that the latter enable the fitting of the adjacent edges of the plates.

On the other hand, the width of the ribs 12 may be different from that of the protuberances or tongues 14, as is seen moreover from FIGS. 3 and 4.

We claim:

1. Lining for a metallurgical container, comprising a series of removable plates of heat insulating material adapted to be applied to the inside of the metallurgical container against the lateral walls and the bottom of the latter, at least a part of these plates being quadrangular and identical, the guadrangular and identical plates adapted to be applied against the lateral walls of the container comprising on their two opposite edges a rib extending over a length greater than the height of the level of liquid metal which has to be introduced into the container, this rib defining a support surface adapted to receive an identical rib formed along the adjacent edge of another said plate, the support surfaces defined by the two ribs formed on the opposite edges of a said plate being oriented in the same direction, and each plate comprising on its two opposite edges on the part thereof which is not provided with said rib, a protuberance defining a support surface oriented in the opposite direction with respect to that of the rib, the support surface of this protuberance being adapted to receive an identical protuberance formed on the adjacent edge of another said plate.

2. Lining according to claim 1, wherein the surfaces opposite the support surfaces defined by the ribs and the protuberances are situated in the extension of the corresponding surface of the plate.

3. Lining according to claim 1, at least a part of the plates to be applied to the bottom of the container being quadrangular and identical, these plates including on one of their surfaces and along two opposite edges, a groove adapted to receive the lower edge of the plates including the ribs and protuberances.

4. Lining according to claim 3, wherein said grooves have a V-shaped cross section, the lower edge of the plates being of a profile complementary to the cross section of these grooves.

5. Lining according to claim 3, wherein the two other edges of the plates adapted to be applied to the bottom of the metallurgical container include on one, a longitudinal recess of V-shaped cross section and on the other, a longitudinal projection of cross section complementary to this recess.

6. Lining according to claim 1, in which said ribs extend most of the height of said plates.

* * * * *